US005933993A

United States Patent [19]

Riley

[11] Patent Number: 5,933,993

[45] **Date of Patent: *Aug. 10, 1999**

[54] COMPUTER GENERATED MULTI-WEB MOISTURE PROOF IDENTIFICATION BRACELET

[76] Inventor: James M. Riley, #4 Picardy La., St. Louis, Mo. 63124

[ * ] Notice: This patent is subject to a terminal disclaimer.

[21] Appl. No.: 09/104,292

[22] Filed: Jun. 24, 1998

Related U.S. Application Data

[63] Continuation-in-part of application No. 08/949,578, Oct. 14, 1997.

[51] Int. Cl.[6] ..... A44C 5/00

[52] U.S. Cl. ..... 40/633; 283/75; 283/109

[58] Field of Search ..... 40/633; 283/74, 283/75, 80, 109, 900; 428/57, 61

[56] References Cited

U.S. PATENT DOCUMENTS

| | | | |
|---|---|---|---|
| Re. 33,616 | 6/1991 | Welsch | 428/57 X |
| 4,627,994 | 12/1986 | Welsch | 428/57 X |
| 4,682,431 | 7/1987 | Kowalchuk . | |
| 4,696,843 | 9/1987 | Schmidt | 428/57 X |
| 4,956,931 | 9/1990 | Selke | 40/633 |
| 5,026,084 | 6/1991 | Pasfield | 283/75 |
| 5,045,426 | 9/1991 | Maierson et al. . | |
| 5,135,789 | 8/1992 | Schmidt | 428/61 X |
| 5,318,326 | 6/1994 | Garrison | 283/101 |
| 5,370,420 | 12/1994 | Khatib et al. | 283/81 |
| 5,383,686 | 1/1995 | Laurash | 283/81 |
| 5,418,026 | 5/1995 | Dronzek, Jr. et al. . | |
| 5,486,021 | 1/1996 | Laurash | 283/81 |
| 5,486,436 | 1/1996 | Lakes . | |
| 5,509,694 | 4/1996 | Laurash et al. | 283/81 |
| 5,518,787 | 5/1996 | Konkol . | |
| 5,524,934 | 6/1996 | Schwan et al. | 283/95 |
| 5,547,227 | 8/1996 | Laurash et al. | 283/81 |
| 5,586,788 | 12/1996 | Laurash | 283/81 |
| 5,595,404 | 1/1997 | Skees | 283/116 |
| 5,598,970 | 2/1997 | Mudry et al. | 229/305 |
| 5,601,313 | 2/1997 | Konkol et al. | 283/81 |
| 5,648,143 | 7/1997 | Mehta et al. . | |
| 5,653,472 | 8/1997 | Huddleston et al. | 283/75 |
| 5,662,976 | 9/1997 | Popat et al. . | |
| 5,687,903 | 11/1997 | Akridge et al. | 229/75 |

FOREIGN PATENT DOCUMENTS

WO 96/12618 5/1996 WIPO .

OTHER PUBLICATIONS

Sample of Avery Dennison DuraCard™ labels.
Avery Laminated Identification Cards #5361.
Sample of Standard Register labels.

*Primary Examiner*—Joanne Silbermann
*Attorney, Agent, or Firm*—Howell & Haferkamp, L.C.

[57] ABSTRACT

A multi-layer, multi-web, laser printable, page-sized form with an identification band blank comprises a multi-layered web die cut with a first paper label portion for receiving a printed image and an adhesive backed transparent film layer approximately twice the width of the paper layer so that upon separation from a carrier, the transparent film may be folded over and completely encapsulate the paper layer to moisture proof it and protect it. The transparent film layer includes a pair of adhesive backed tabs at the ends to facilitate its attachment about a patient's wrist or ankle. The band blank web is joined to a second multi-layer web with an overlapping glued joint, the second multi-layer web having a plurality of adhesive backed labels die cut into it.

17 Claims, 3 Drawing Sheets

COMPUTER GENERATED MULTI-WEB MOISTURE PROOF IDENTIFICATION BRACELET

CROSS REFERENCE TO RELATED APPLICATION

This application is a continuation-in-part of Ser. No. 08/949,578, filed on Oct. 14, 1997.

BACKGROUND AND SUMMARY OF THE INVENTION

Identification bands are used in many applications, including particularly in hospitals or the like for patients upon admission. In such instances, when a patient is admitted, information is taken from the patient with respect to his medical history, and, during the course of the patient's stay, it's not unlikely that various kinds of medications and treatments are given to the patient. For these reasons, and others, it is important to keep track of the patients in a reliable manner with an identification bracelet which will withstand the vagaries of a hospital environment.

As the admission and processing of patients in hospitals becomes more automated with computers, there has developed a need in the art for an identification band which may be secured about a patient's wrist or ankle, for example, and which is readily generated through the same computer system as is used to in-process the patient himself. Commonly, and at the present time, these computer systems routinely print admission forms on laser printers.

In the prior art, identification bands have tended to be ruggedized and moisture proofed in order to insure that they are not easily removed by either the staff or the patient, inadvertently or on purpose. Additionally, various arrangements have been provided in the prior art for moisture proofing these identification bands by overlying the band with a plastic film or surrounding it in a plastic sleeve or the like. Of course, this complex structure and arrangement requires time for a medical professional not only to assemble the patient identification band but also to apply it to the patient in a secure manner. As hospitals process patients in significant numbers, the time required to prepare and apply patient identification bands can be significant and requires more than a minor intrusion into a medical professional's daily task.

Still another problem with prior art identification bands is their relatively narrow width. This narrow width limits the font size of printing and thereby renders the band difficult to read. In many instances, the bands were hand lettered or manually typed which created additional problems relating to the physical handling of the bands and the resulting "readability" problems caused by illegible or mis-aligned printing or typing.

With the advent of computer systems, including laser printers, there have been attempts in the prior art to solve these needs, with varying degrees of success. For example, U.S. Pat. No. 4,682,431 discloses a continuous form admission record with an adhesive backed patient identification band which may be removed from the continuous form after the patient's name and any identifying data is printed thereon, the band folded over on itself for adhering adhesive backed portions of the band together, and then securing the band to a patient's wrist by folding it into a loop and joining its ends by use of an adhesive tab. However, the construction of the '431 patented band has several drawbacks. One such drawback is that the data printed on the identification band remains exposed after the band is applied to a patient's wrist.

While special, more expensive, types of paper or plastic stock may be used, which will help to minimize any obliteration or alteration of the data, this increases the cost of the band and does not provide a full solution. Furthermore, as the disclosure is best understood, the adhesive tab which secures the opposite end of the band to hold it in a loop appears to be nonoverlapping such that its integrity may be readily breached.

The inventor herein is also aware of prior art identification badges or cards formed in a multi-part form wherein a paper layer provides a surface for the printing of identification information including a person's name, and a second layer of adhesive backed film is oversized so that upon separation of the badge from a carrier, the transparent film may be folded over to overlie the card. As best known to the inventor, these name badges have been used and recommended in the prior art for convention name tags, membership cards and the like which may be directly pinned onto a wearer's clothing, slipped into a plastic carrier for pinning onto a wearer's person, or carried in a wallet, or otherwise affixed with separate supporting structure. This product is available commercially under the trademark DURACARD from Avery Dennison and is apparently disclosed in U.S. Pat. No. 5,662,976.

In order to solve these and other problems in the prior art, the inventor has succeeded in designing and developing an identification band blank formed as part of a multi-part, standard page-sized, form which is readily adaptable for use in recording a patient's admission to a hospital or other health care facility, for example. An upper portion of the page-sized form may be comprised simply of a matrix of adhesive backed identification labels which may be removed conveniently to adhere to the patient's utensils, hospital chart, room sign, etc. At the same time, another portion of this page-sized form includes multi-layered identification band blanks of the present invention.

In a preferred embodiment, the page-sized form is comprised of two layers, a paper stock layer and an adhesive backed transparent film layer. The paper stock is suitable for accepting an image printed thereon by a laser printer or the like and can be relatively inexpensive paper stock as will be seen momentarily. With this construction, the band blank can be thought of as an "open system" form. By that is meant the band blank can be any standard, or special, paper or paper size for printing in any printer with any suitable ink.

In another preferred embodiment, the page-sized form is comprised from two webs, with a first web forming the upper portion and a second web forming the lower portion, the lower portion containing the multi-layered identification band blanks. These two webs may themselves be formed from different materials, as desired, to accommodate different printers, applications for users, ink requirements, strength or flexibility needs, or any other processing or use environment or need. For example, the upper portion or first web may be formed with a top layer of adhesive backed paper stock with a bottom layer of a coated liner. The lower portion or second web may be formed with a top layer of paper and a bottom layer of an adhesive backed transparent film. After the two webs are individually formed, the webs are joined such as by being overlapped and glued together along their length, and then cut to form the desired page-sized form. In either embodiment a line of perforation may be added to separate the two portions from each other so that a user may conveniently separate the portions to separate the bracelet from the labels.

In either embodiment, the outline of the paper may be kiss-cut into the paper stock such that only the paper stock portion of the multi-layer form is cut for separation from its surrounding paper layer. The transparent adhesive backed film which comprises the other half of the identification band blank is also kiss-cut but has a size more than twice the width of the paper label portion so that upon separation from the carrier, the transparent film may be folded along a fold line to completely overlay, surround, and encapsulate the paper label portion. An edge of adhesive backed film surrounds the entire circumference of the paper label so that a completely moistureproof seal is formed. Also, each "half" of the transparent film includes an adhesive backed tab extending from its edge so that as the transparent film is folded over, the identification band blank has an adhesive backed tab at either end and aligned for securing the band blank about a patient's wrist or ankle. As each of the tabs are adhesive backed, and they are arranged to join with each other on their adhesive surfaces, a rather secure attachment is provided when the patient's wrist is appropriately sized. However, in most instances this is not the case. As each tab has its own adhesive layer, the tabs need not overlie one another and instead will attach to other parts of the band blank such that the identification band blank may also be attached conveniently to a typically sized wrist.

In an alternative construction, a second set of kiss-cuts, of greater strength such that they are not as readily separated, may be formed in the identification band blank and used to provide a reduced length identification band blank for children or infants, as required. With this alternative construction, reduced inventory of the page-sized forms is permitted as the form may be used for virtually any patient being admitted to the hospital or other institution.

While many of the principal advantages and features have been briefly explained, a more thorough understanding of the invention may be obtained by referring to the drawings and description of the preferred embodiment which follows.

DETAILED DESCRIPTION OF THE PREFERRED EMBODIMENTS

Figure 1:
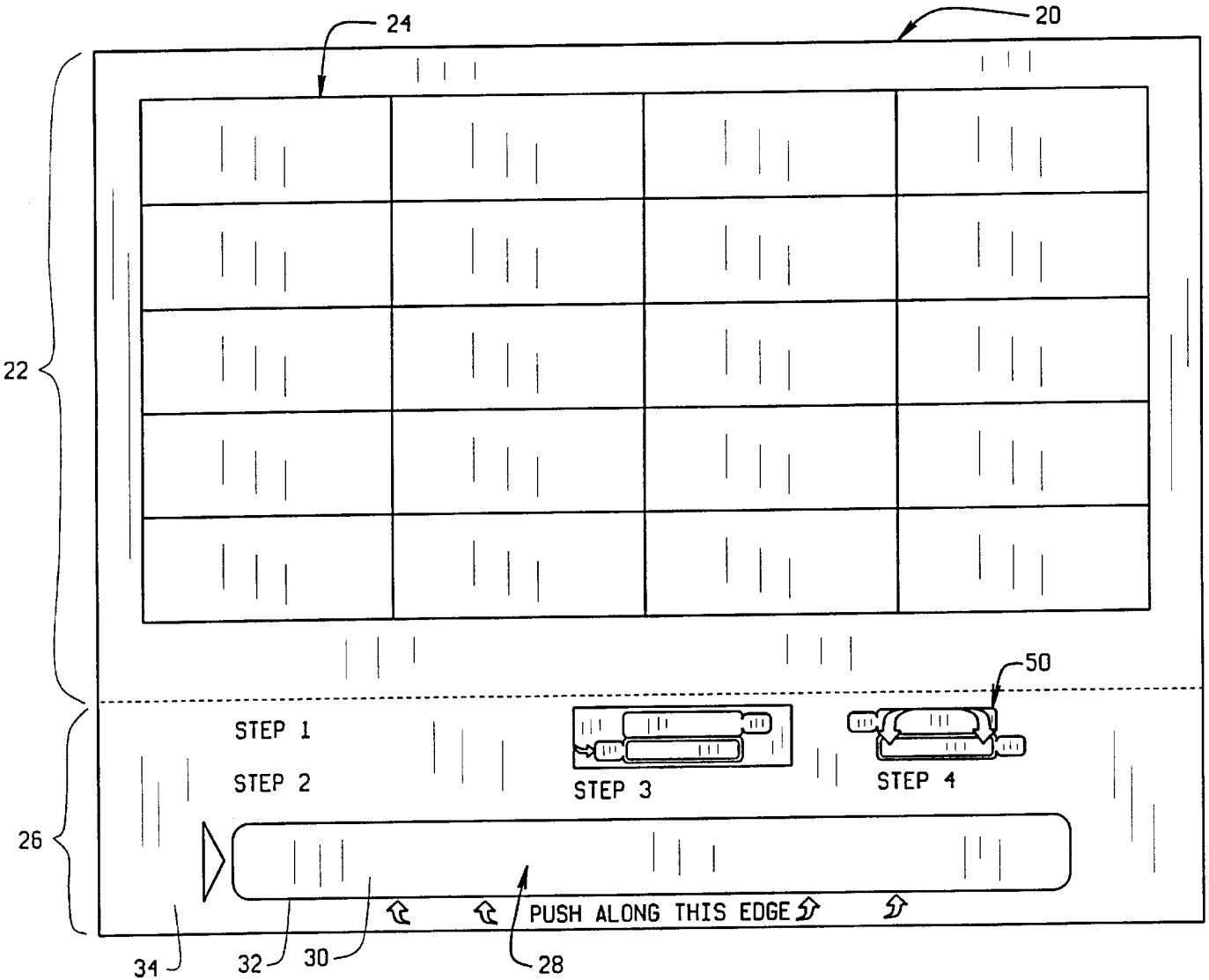
FIG. 1 is a top view of a page-sized form of the present invention illustrating the paper, image receivable, side of the form with instructions provided for separating the identification band blank and assembling it.

As shown in FIG. 1, a page-sized, multi-layered form 20 may be suitably sized for automatic feeding in a common laser printer, as known in the art. The page-sized form 20 is divided into a first portion 22 which may be practically anything as suited to the particular application. For example, as illustrated in FIG. 1, a 4×5 matrix of individually die cut labels 24 may each be pre-printed with the patient's name, social security number, address, attending physician, date of admission, and even a bar code or other identifying indicia. These labels 24 may then be used as desired by the staff to identify the patient's articles, room, medicine containers, and other things for proper medical attention and for billing and administrative purposes as well. A second portion 26 of the form 20 includes the identification band blank 28. As viewed in FIG. 1, the paper stock element 30 is shown upon which an image may be printed by the laser printer, as mentioned above. The outline of the label 30 is defined by a dye cut 32 which may be a kiss-cut through the paper stock layer of multi-layer form 20, as known in the art. With a kiss-cut, the label portion 30 may be readily separated from the carrier 34 surrounding it and separated from it by kiss-cut 32.

Figure 3:
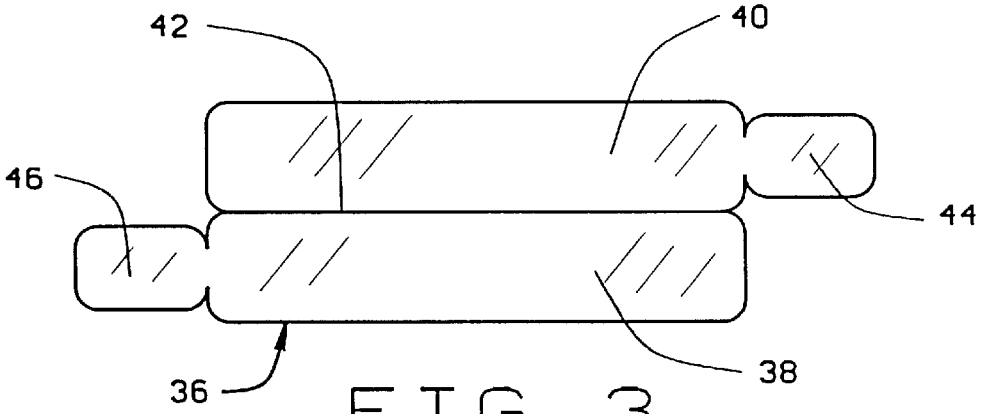
FIG. 3 is a plan view solely of the adhesive backed transparent film portion of the identification band blank.
Figure 4:
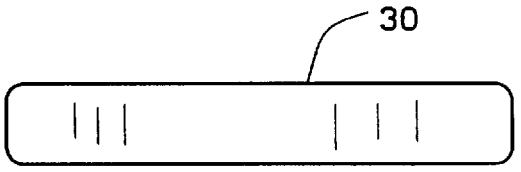
FIG. 4 is a plan view solely of the paper stock portion of the identification band blank.

As illustrated in the instructions portion shown in FIG. 1, and FIG. 3, the identification band blank 28 includes an adhesive backed, transparent film portion 36 having a lower half 38 separated from an upper half 40 by a fold line 42. Adhesive backed tabs 44, 46 are formed at one end of each of tabs 38, 40. Although not shown in FIG. 1, but similarly to the kiss-cut 32 provided to separate label portion 30 from carrier 34, another kiss-cut is made in the transparent film layer to allow for the ready separation of transparent film portion 36 from its surrounding carrier in the transparent film layer. A pair of notches 47, 49 are provided in the film portion 36 which are aligned with the fold line 42 which help to separate the film from the surrounding carrier and which also form a contour which follows the rounded edges of the paper label portion 30.

Figure 2:
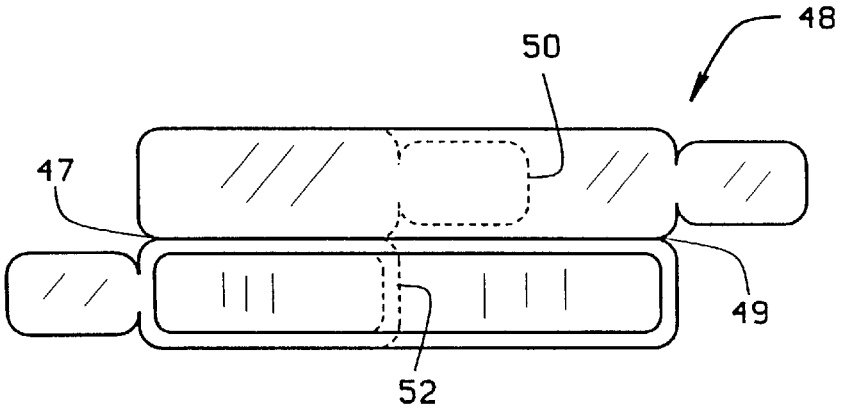
FIG. 2 is a plan view solely of the identification band blank with the additional midstrength perforations of the alternative embodiment.

An alternative embodiment 48 is shown in FIG. 2. It includes, in addition to the kiss-cuts of the preferred embodiment, a second set of mid-strength perforations 50 and 52 which allow, with somewhat greater effort, a clean tearing away of a portion of the identification band blank in order to provide a smaller length version thereof. This is particularly helpful to accommodate smaller wrists such as those of infants and children. Also, this feature permits a single page-sized form 20 to be utilized as inventory and yet provide convenient and comfortable fit of the identification band bracelet 28 about infant's wrists as well. However, it should be noted that adhesive backed tabs 44, 46 need not be affixed to each other and instead the identification band blank may overlap itself and be secured with a single tab 44 or 46.

Figure 5:
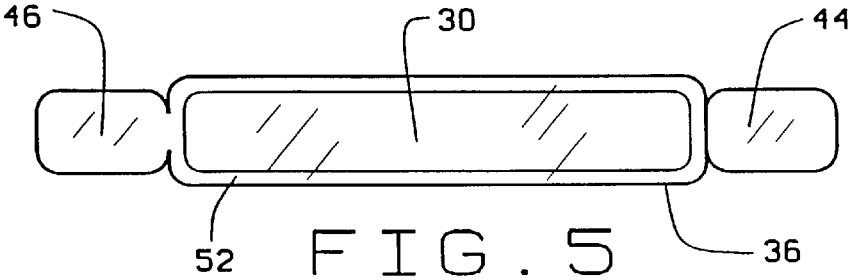
FIG. 5 is a plan view of an assembled identification band blank of the present invention.

In operation, for example, as the present invention is adapted to a hospital admission of a patient, the appropriate information is taken from the patient and the computer causes the laser printer to preprint the label portion of the identification band blank. Then, following the easy instructions as shown in FIG. 1, the identification bank blank is separated both from the paper side as well as the transparent film side of the multi-layered form to arrive at a separated, but unassembled identification band blank as shown at 50. To complete the preassembly of the identification band blank, the upper half 40 of the transparent film layer is folded about fold line 42 to overlie the paper label 30 and adhere to the adhesive side of the lower half 38. This completed construction is shown in FIG. 5. As shown therein, the paper label portion 30 has a silhouette which is narrower than the width of the folded over transparent film layer such that an adhesive-to-adhesive seal completely surrounds and encapsulates the paper label portion 30. In other words, a picture frame 52 of sealed halves of the transparent film surround the paper label portion 30. This provides optimum moisture proofing and a protective layer of transparent film overlying the laser printed information contained in the identification band blank.

The identification band blank may then be applied to a patient's wrist by looping it therearound, overlapping tabs 44, 46, such that their adhesive surfaces align with each other and are secured to each other. This provides maximum sealing and fastening strength which, although not completely tamperproof, requires a concerted effort in order to separate and remove the identification band blank. For patients with smaller wrists, the band blank may be overlapped as it encircles the wrist and the tabs adhered to the body of the band blank.

Figure 6:
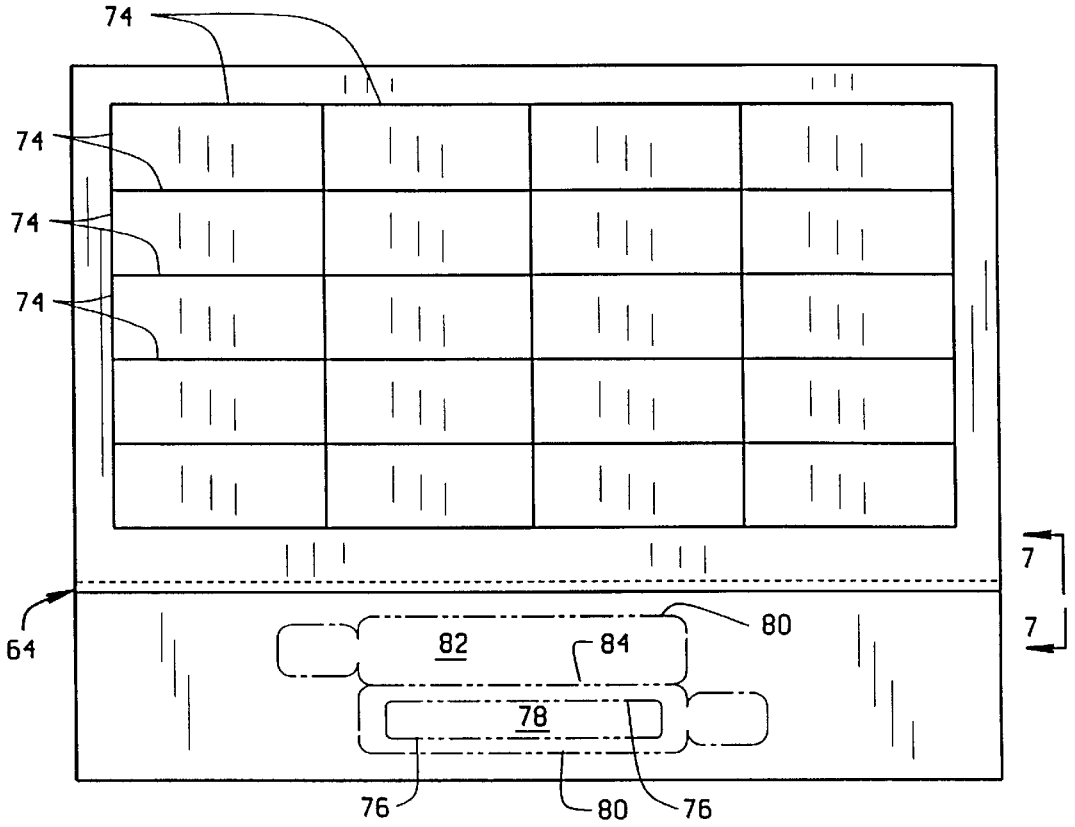
FIG. 6 is a plan view of another embodiment of the invention utilizing two webs glued together to construct the page-sized form.
Figure 7:
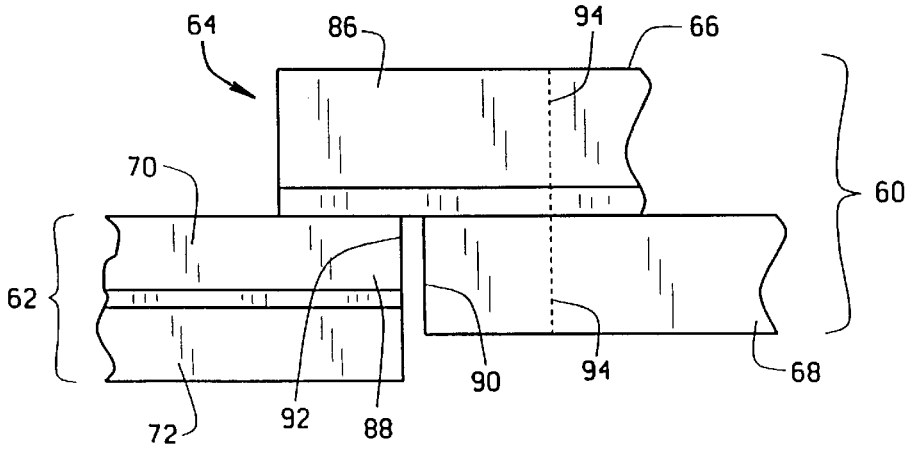
FIG. 7 is a partial cross-sectional view taken along the plane of lines 7—7 in FIG. 6 and further detailing the glued joint between the two webs of the embodiment of FIG. 6.

Still another embodiment of the invention is shown in FIGS. 6 and 7. In this embodiment, two separate webs 60,62 are preferably separately formed and joined together at a joint 64, which preferably is a lapped and glued joint, with each web 60,62 being preferably comprised of two layers of material chosen from a number of materials as desired by a user and to suit any particular application as would be known to those of skill in the art. By way of example only, and not to be limiting in any sense, the first web 60 may preferably be formed by a top layer 66 of an adhesive backed paper stick and a bottom layer of a liner 68. The second web 62 may preferably be formed by a top layer 70 of a somewhat thinner liner paper suitable for accepting laser printing and a bottom layer 72 of an adhesive backed transparent film or vinyl which exhibits moisture resistance and tearing. As in the other embodiments of the present invention, the top layer 66 of the first web 60 may preferably be die cut along lines 74 into a matrix, such as a 4×5 matrix as depicted in FIG. 6, of self adhesive labels which may be printed with a patient's name, social security or other identifying number, address, medical information, or other desired information for use as a supplement to the band blank of the second web 62. More particularly, and without limiting in any sense, the second web 62 may preferably have its top layer 70 die cut along line 76 to form the paper label portion 78 of the band blank which receives the printing from the laser or other computer controlled printer (it being understood that a laser or any other presently known or later developed computer controlled printer could be used to print the band blanks of the present invention as would be well known to those of ordinary skill in the art). The bottom layer 72 may preferably be die cut along line 80 which is a peripheral line surrounding the transparent layer 82 which separates from layer 72 as previously explained to encapsulate the paper label portion 78 of the band blank. A line 84 of perforation essentially dissects the transparent layer 82 and provides a guide for folding over the transparent layer 82 to encapsulate the paper label portion 78 and form the completed band blank.

As shown in greater detail in FIG. 7, the joint 64 is preferably formed as an overlapping and glued joint between the layers of the two webs. As shown therein, the top layer 66 has an overlapping flap 86 of adhesive backed paper stock which overlies corresponding shelf portion 88 of the top layer 70 of the second web 62 to which it adheres. The two webs 60, 62 may preferably be aligned to create the joint by the physical abutment of the edge 90 of the bottom layer 68 of the first web 60 with the edge 92 of the second web 62, or otherwise as would be known to those of ordinary skill in the art. A line of perforation 94 may preferably be cut into both layers 66, 68 forming first web 60 to facilitate the separation of the upper portion of the form from the bottom portion of the form, as desired. However, it may not be necessary for the perforation line 94 to be provided as the self adhered flap 86 may be lightly enough adhered to the shelf portion 88 so that it may instead be peeled off to thereby separate the two webs 60, 62. Presumably, this separation would occur after the form has been printed by the user. With this construction, the two webs 60, 62 are preferably separately formed and later assembled into a single web which may then be cut to length to form the page-sized forms. By page-sized it is meant any size as would be conveniently processed in a single pass through any printer. For example, page-sized could include standard letter size, legal size, A4 size, 11×17 size, etc., subject only to the processing capability of the particular printer chosen for use with the form. Should different materials be required for any particular application, it is then only necessary for one of the webs to be modified, and the modified form may then be conveniently assembled as before with perhaps one of the webs remaining as previously constructed. Thus, greater flexibility is provided with this embodiment.

In some applications, it may be desirable to utilize only the web which contains the band blank. In these instances, it is anticipated by the user that the associated self adhering labels which are so convenient are not needed for any number of reasons such as for outpatient processing where there will not be any utensils or other articles assigned to the patient which need to be marked with the patient's name. For these situations, the form may be sized for processing through the envelope tray of the printer, or a dummy second web joined to the band blank web to render it page sized, or the form modified as desired to be conveniently processed by any particular printer as would be readily apparent to one of ordinary skill in the art. In such instances, the band blank web would preferably comprise the only functioning portion of the form and the printer would preferably print solely onto the band blank. This embodiment of the present invention provides the flexibility for the invention to be used in these applications without cutting the excess portion of the form away, or without wasting the other web if left intact. Furthermore, from a production standpoint, a manufacturer need only manufacture the single band blank web of this embodiment to satisfy the need for these applications in addition to those for which the page-sized form is desired.

The joint 64 between the two webs 60, 62 is preferably a lapped, glued joint as shown and described above. However, the two webs may be joined in any alternative fashion, as would be well known to those of ordinary skill in the art. For example, the two webs may be joined without overlap, they may be joined with a binder tape overlapping both of the webs, the other web may overlap, or they may be joined in any other convenient way which would accommodate the relatively jam-free processing of the form by the printer selected for use. One of the limitations associated with present day single page, automatic feed printers is that they have a relatively complex paper path which may lead to jamming or misfeeding of a page sized form should there be a varying thickness across the sheet. As can be appreciated, with the present invention this varying thickness is controlled by thoughtful selection of the materials which form the webs. The same considerations apply when selecting the joint used to join the webs.

Still another consideration in utilizing the present invention in automatic feed printers is the possibility of jamming due to adjacent sheets becoming attracted to each other through build up of static electricity, heat, or through other conditions. Again, with this embodiment of the present invention these kind of problems are readily solved by those of ordinary skill in the art and with increased flexibility through proper selection of materials for forming the webs. The inventor has found that different printers exhibit different levels of tolerance for different materials so that one grouping of materials chosen may work well for one manufacturer's printer and not so well in another manufacturer's printer. These kinds of adjustments in choosing and adapting materials for a particular printer are considered to be within the abilities of one of ordinary skill in the art.

Various changes may be made to the invention as would be apparent to those skilled in the art. However, the invention is limited only by the scope of the claims appended hereto, and their equivalents.

What is claimed is:

1. A multi-web approximately page-sized form suitable for processing through a computer controlled laser printer, each of said webs comprising a multi-web construction being formed separately from each other and a joint joining said webs to each other along a common edge thereof to form the multi-web construction, at least one of said webs containing a multi-web band blank, said band blank comprising a first layer suitable for receiving a print image from said printer and a second, over-sized layer of moisture resistant material so that upon removal of said band blank from said form the second layer may be folded over to overlie the printed image on the first layer and secured about the person's appendage.

2. The form of claim 1 wherein the second layer is sufficiently transparent that the printed image on the first layer may be readily viewed therethrough.

3. The form of claim 2 wherein the form is comprised of two webs, said webs being joined along an edge thereof.

4. The form of claim 3 wherein one of said webs overlaps the other of said webs and is glued at said joined edge.

5. The form of claim 4 further comprising a line of perforation proximate said joined edge so that said form may be separated into at least two portions.

6. The form of claim 4 wherein said band blank further comprises an adhesive backed tab near at least one end thereof to facilitate the securing of said band blank.

7. The form of claim 6 wherein said band blank comprises an adhesive backed tab near both ends thereof.

8. The form of claim 7 wherein said adhesive backed tabs are formed in the second, substantially transparent layer.

9. The form of claim 8 wherein said second web has two layers formed from different materials than comprises the first web.

10. An approximately page-sized form comprised of two joined webs, each of said webs comprising two layers of dissimilar materials, a first one of said webs having a band blank die cut therein to facilitate its separation from said first web, said band blank comprising a first layer suitable for receiving a print image and a second, over-sized layer of moisture resistant material, said webs being joined along an adjacent edge with an overlapping glued joint, and a second one of said webs comprising a plurality of adhesive backed labels die cut thereinto.

11. The form of claim 10 wherein said band blank is, when assembled by separating it from its associated web and folding over the second layer to overlie the first layer, substantially shaped as a bracelet and further comprises an adhesive backed tab near each end thereof to facilitate its attachment to a person.

12. The form of claim 11 further comprising a line of perforation extending substantially the length of said form and substantially adjacent said joint to facilitate the separation of said form into two portions each of which is substantially one of said webs.

13. The form of claim 11 wherein the second web is substantially wider than the first web.

14. The form of claim 13 wherein the glued joint is formed with at least one of the layers of one of the webs abutting at least one of the layers of the other web, and one web layer overlying a layer of the other web and being adhered thereto.

15. The form of claim 14 wherein each layer of each web is made of a different material than the material used for the other layers of each web.

16. An approximately page-sized form constructed from a pair of webs joined along an edge thereof with a glued joint, each of said webs having two layers self adhered to each other, one of said webs having a multi-layer bracelet die cut thereinto, said bracelet including a substantially rectangular shaped label portion for receiving a print image and an oversized transparent film portion sufficiently sized to substantially encapsulate the label portion upon its separation from the web and folding over the label portion, and the second web comprising a plurality of self adhering labels die cut thereinto.

17. The form of claim 16 wherein said bracelet includes an integrally formed, self adhering tab near each end of the transparent film portion for attaching the bracelet to a person.

* * * * *

UNITED STATES PATENT AND TRADEMARK OFFICE

CERTIFICATE OF CORRECTION

PATENT : 5,933,993

DATED : August 10, 1999

INVENTOR(S) : Riley

It is certified that error appears in the above-identified patent and that said Letters Patent is hereby corrected as shown below:

Sheet 1 of 3, FIG. 1, substitute --51-- for "50"; and add --21-- to the perforated line separating section 22 from section 26.

Sheet 2 of 3, FIG. 5, substitute --53-- for "52".

In Col. 3, line 65, insert --by a perforation 21-- after "divided".

In Col. 3, line 66, insert --, and a second portion 26-- after "application" and before ".".

In Col. 4, line 55, substitute --51-- for "50".

In Col. 4, line 65, substitute --53-- for "52".

Signed and Sealed this

Second Day of January, 2001

*Attest:*

*Attesting Officer*

Q. TODD DICKINSON

*Commissioner of Patents and Trademarks*